US011091989B1

(12) United States Patent
De Oliveira et al.

(10) Patent No.: US 11,091,989 B1
(45) Date of Patent: Aug. 17, 2021

(54) REAL-TIME PARAMETER ADJUSTMENT IN WELLBORE DRILLING OPERATIONS

(71) Applicant: Halliburton Energy Services, Inc., Houston, TX (US)

(72) Inventors: Claudia Lucia Bonin De Oliveira, Katy, TX (US); Dale E. Jamison, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/123,837

(22) Filed: Dec. 16, 2020

(51) Int. Cl.

| | |
|---|---|
| ***E21B 44/00*** | (2006.01) |
| ***E21B 7/04*** | (2006.01) |
| ***E21B 49/00*** | (2006.01) |
| ***E21B 43/14*** | (2006.01) |
| ***E21B 47/06*** | (2012.01) |
| *E21B 43/26* | (2006.01) |

(52) U.S. Cl.
CPC ..... *E21B 43/14* (2013.01); *E21B 44/005* (2013.01); *E21B 47/06* (2013.01); *E21B 49/003* (2013.01); *E21B 49/005* (2013.01); *E21B 43/26* (2013.01); *E21B 2200/20* (2020.05); *E21B 2200/22* (2020.05)

(58) Field of Classification Search
CPC ..... E21B 44/005; E21B 44/02; E21B 44/06; E21B 7/04; E21B 41/0035; E21B 41/0099; E21B 49/003; E21B 49/005; E21B 49/006
See application file for complete search history.

(56) References Cited

U.S. PATENT DOCUMENTS

| | | | | |
|---|---|---|---|---|
| 5,812,068 A * | 9/1998 | Wisler | E21B 47/022 | 340/855.5 |
| 5,868,210 A * | 2/1999 | Johnson | B04B 1/08 | 175/40 |
| 6,220,087 B1 * | 4/2001 | Hache | E21B 47/06 | 73/152.46 |
| 6,904,365 B2 * | 6/2005 | Bratton | G01V 1/50 | 702/9 |
| 7,251,566 B2 * | 7/2007 | Wu | G01V 1/46 | 702/6 |
| 9,638,022 B2 * | 5/2017 | Bittar | G01V 1/34 | |

(Continued)

FOREIGN PATENT DOCUMENTS

GB 2503136 4/2019

OTHER PUBLICATIONS

Halliburton, "BaraLogix Applied Fluids Optimization", 2 pages.

*Primary Examiner* — Kenneth L Thompson
(74) *Attorney, Agent, or Firm* — Kilpatrick Townsend & Stockton LLP

(57) ABSTRACT

A system can determine properties associated with a plurality of wellbore zones extending radially outward from a wellbore of a drilling operation. The system can determine an operating window for a drilling pressure of the drilling operation based on the properties associated with the plurality of wellbore zones. The system can access real-time data for the plurality of wellbore zones during the drilling operation. The system can determine an adjusted operating window for the drilling pressure based on the real-time data. The system can output a command to adjust, in real time, at least one drilling parameter of the drilling operation based on the adjusted operating window.

20 Claims, 5 Drawing Sheets

(56) References Cited

U.S. PATENT DOCUMENTS

| | | | | |
|---|---|---|---|---|
| 10,329,892 | B2 | 6/2019 | Bermudez Martinez | |
| 10,711,546 | B2 * | 7/2020 | Turner | E21B 19/16 |
| 2016/0222741 | A1 | 8/2016 | Lovorn et al. | |
| 2020/0190960 | A1 * | 6/2020 | Wessling | E21B 47/026 |
| 2021/0017847 | A1 * | 1/2021 | Aragall | E21B 21/08 |

* cited by examiner

REAL-TIME PARAMETER ADJUSTMENT IN WELLBORE DRILLING OPERATIONS

TECHNICAL FIELD

The present disclosure relates generally to wellbore drilling operations and, more particularly (although not necessarily exclusively), to automatically adjusting parameters of a drilling operation based on detection and analysis of a drilling pressure operating window.

BACKGROUND

Hydrocarbon exploration is the search for hydrocarbons, such as oil or gas, within a subterranean formation. During a drilling operation of hydrocarbon exploration, adverse events, such as lost circulation, within a wellbore can lead to increased drilling costs and drilling time, such as nonproductive time (NPT) and invisible loss time (ILT). Wellbore stability techniques attempt to manage drilling parameters in association with geomechanic properties of the subterranean formation to avoid adverse events during the drilling operation. Maintaining wellbore stability can be difficult due to a lack of a system for accurately analyzing properties of the subterranean formation prior to drilling and for analyzing real-time data during the drilling operation to predict and avoid the adverse events.

DETAILED DESCRIPTION

Figure 1:
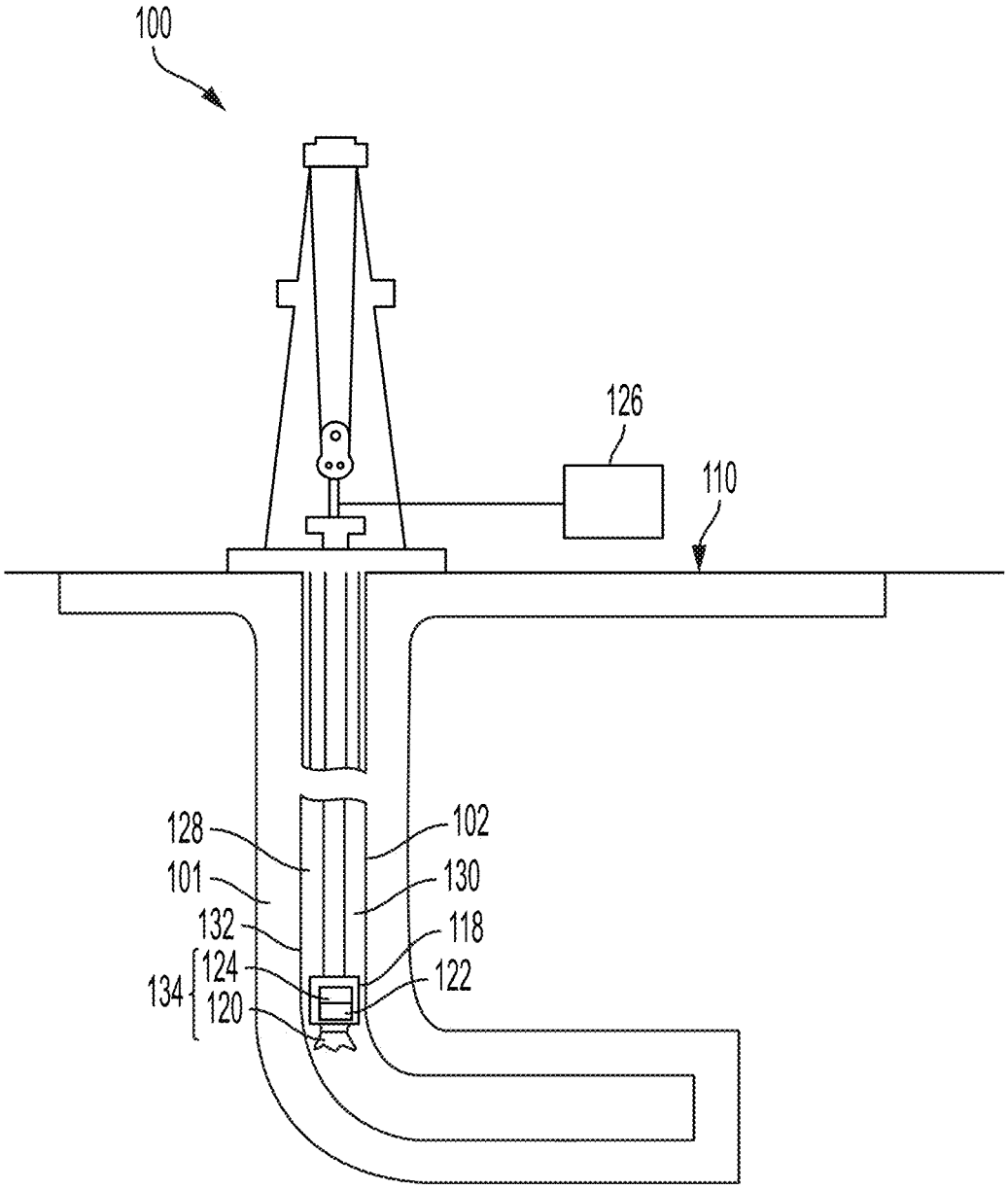
FIG. 1 is a schematic diagram of a drilling rig for drilling a wellbore into a subterranean formation according to one example of the present disclosure.

Certain aspects and examples of the present disclosure relate to dynamically adjusting parameters of a drilling operation. The parameters can include a wellbore pressure, mud weight, fluid properties, weight on bit, torque, wellbore trajectory, and the like. By using a system according to some examples, parameters for the drilling operation can be adjusted in real time based on an operating window of a drilling pressure for the drilling operation. The techniques described in the present disclosure may reduce invisible lost time and nonproductive time of drilling operations.

Wellbore stability is multi-faceted and often approached only partially when wellbore operators ignore or otherwise discount connections between elements of wellbore planning and wellbore monitoring. A wellbore may be considered stable when a mud-weight operating window is maintained between a pore pressure and a shear collapse pressure in the wellbore. An increased number of unnoticed risks, invisible loss time, missed opportunities for continuous improvement that may result in nonproductive time, and sidetracking may all occur in typical approaches to wellbore stability. Geomechanics modeling can improve an insight into potential wellbore instability risk in oil and gas drilling. Available information prior to drilling and real-time information obtained while drilling can be used to manage drilling conditions that can improve wellbore stability during drilling and tripping operations of the wellbore.

Wellbore drilling is a multi-physics phenomenon encompassing rock material mechanical behavior, fluid dynamics, thermodynamic energy and mass transport, and mechanical engineering. Drilling impact is multifactor and includes economic, logistical, health, safety, and environmental concerns. It may be desirable for a wellbore operator to drill the wellbore to attain a target with the least reservoir formation interference. Wellbore stability and wellbore quality can be part of the balance for attaining optimal performance in drilling the wellbore, and the optimal performance in drilling the wellbore can be a minimum amount of time used to drill the wellbore with an acceptable wellbore quality. Wellbore stability may be managed by combining the information obtained prior to drilling and the real-time information obtained during drilling such that the wellbore remains stable while other optimization criteria of the wellbore are satisfied.

Certain embodiments of the present disclosure combine wellbore stability criteria of time dependent rock failure and drilling fluid optimization to improve wellbore quality and reduce risk levels while supporting decision making in real time. A subterranean formation can be segmented into wellbore zones so that elements can be clearly described and visualized during modeling, monitoring, and controlling the drilling operation. The wellbore zones can include a wellbore zone, a near-wellbore zone, and a far-field zone. The wellbore zones can be sequentially and quasi-simultaneously analyzed in real time during the drilling operation. The wellbore zones can be analyzed by advanced sensors and real-time data from the wellbore zones can be applied to physics-based models to determine features of each of the wellbore zones. A usable operating window for a drilling pressure can be determined in real time using the analysis of the wellbore zones to allow drilling parameters to be adjusted during the drilling operation to ensure wellbore stability. The operating window can be an optimal range of pressures corresponding to a pressure differential between a minimum equivalent static density and a maximum equivalent circulation density of a particular wellbore zone. Visualizing the operating window for mud weight, pump rate, rotary speed, well trajectory, fluid composition and treatment can minimize risk and nonproductive time and/or invisible lost time.

Wellbore stability may be optimized when the wellbore stability can be accurately predicted with successful interpretation of the near-wellbore zone wall's response to drilling and wellbore pressurizing. The interpretation can be determined based on results of the physics-based models. Wellbore stability may additionally be optimized when the drilling fluid composition can be timely prescribed and applied with appropriate density and other fluid properties such as salinity or water phase salinity, oil/water ratio, and additives' concentrations. Additionally, wellbore stability may be optimized when hydraulic and mechanical parameters can be predicted and managed for maintaining an optimal wellbore pressure. Since risks and uncertainty exist, the system may include controls, analytics, and models to maximize accuracy and fidelity of operating window calculations and drilling parameter adjustments.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic diagram of a drilling rig 100 for drilling a wellbore 102 into a subterranean formation 101 according to one example of the present disclosure. In this example, drilling rig 100 is depicted for a well, such as an oil or gas well, for extracting fluids from a subterranean formation 101. The drilling rig 100 may be used to create a wellbore 102 from a surface 110 of the subterranean formation 101. The drilling rig 100 may include a well tool or downhole tool 118, and a drill bit 120. The downhole tool 118 can be any tool used to gather information about the wellbore 102. For example, the downhole tool 118 can be a tool used for measuring-while-drilling or logging-while-drilling operations. The downhole tool 118 can include a sensor component 122 for determining information about the wellbore 102. An example of real-time information can include a pressure-while-drilling. Surface measurements may also be made during the drilling operation. Examples of surface measurements can include rate of penetration, weight on bit, standpipe pressure, depth, mud flow in, rotations per minute, torque, or other parameters. The downhole tool 118 can also include a transmitter 124 for transmitting data from the sensor component 122 to the surface 110. A bottom hole assembly 134 can include the downhole tool 118 and the drill bit 120 for drilling the wellbore 102.

The wellbore 102 is shown as being drilled from the surface 110 and through the subterranean formation 101. As the wellbore 102 is drilled, drilling fluid can be pumped through the drill bit 120 and into the wellbore 102 to enhance drilling operations. As the drilling fluid enters into the wellbore, the drilling fluid circulates back toward the surface 110 through a wellbore annulus 128, which is an area between a drill string 130 and a wall 132 of the wellbore 102.

Also included in the schematic diagram is a computing device 126. The computing device 126 can be communicatively coupled to the downhole tool 118 and receive real-time information about the drilling operation. The computing device 126 can determine an operating window for the drilling pressure for the drilling operation and cause adjustments in real time to parameters of the drilling operation based on the operating window.

Figure 2:
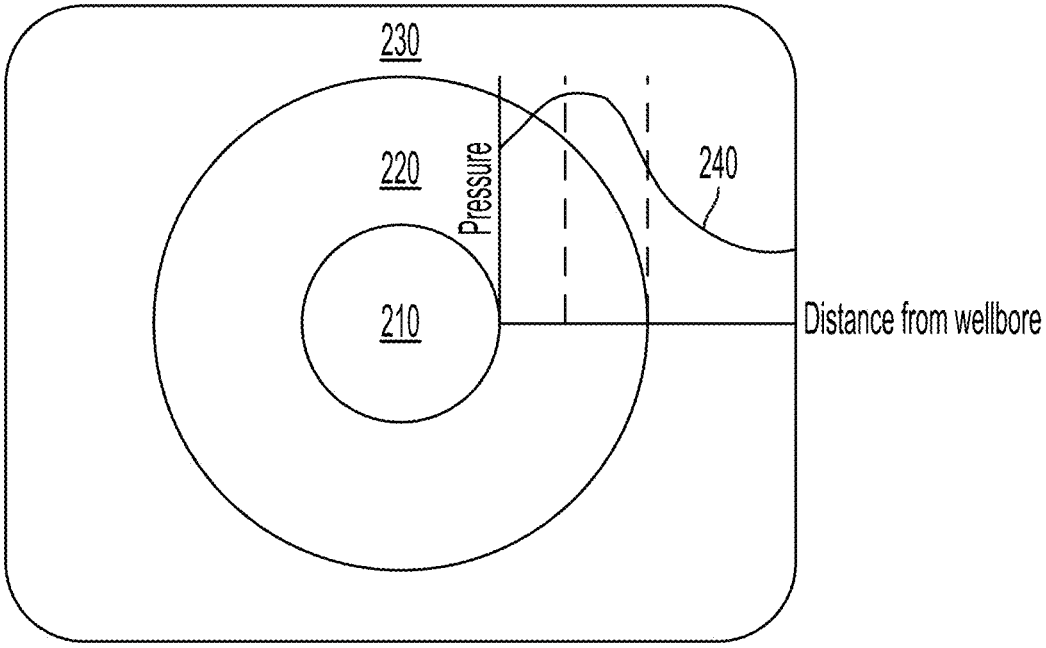
FIG. 2 is a diagram of an example of wellbore zones of a drilling operation according to one example of the present disclosure.

FIG. 2 is a diagram of an example of wellbore zones of a drilling operation according to one example of the present disclosure. Many different wellbore zones can be examined and analyzed at different depths. As illustrated in FIG. 2, the wellbore zones can include a wellbore zone 210, a near-wellbore zone 220, and a far-field zone 230. The wellbore zones 210, 220, and 230 can be defined from the point of view of time dependent failure and event detection. For example, a curve 240 representing a hypothetical variation of pore fluid pressure over a radial distance from the wellbore zone 210 can be used to determine the wellbore zones. In an example, the curve may change over time due to changes in the near-wellbore zone 220 over time. Properties of the wellbore zones can be measured with advanced sensors, such as gamma ray sensors and acoustic sensors, prior to and during drilling to aid in event detection and to determine adjustments for the drilling operation.

In some examples, the wellbore zone 210 corresponds to an area of a subterranean formation where drilling fluid is exerting a pressure against the wall 132 of the wellbore 102. The pressure exerted against the wall 132 of the wellbore 102 may be referred to as the wellbore pressure ($p_w$). The wellbore zone 210 can additionally correspond to an area where carvings and cuttings are transported within the wellbore 102. The near-wellbore zone 220 can correspond to an area of the subterranean formation where the pore fluid pressure, as represented by the curve 240, is affected by the wellbore pressure ($p_w$) based on wellbore fluid filtration properties and rock permeability properties of the formation 101 in the near-wellbore zone 220. Additionally, the near-wellbore zone 220 can be where potential rock failures can occur, which may create additional wellbore volume. The near-wellbore zone 220 can also include an area where the pore fluid and rock stresses are affected by wellbore excavation. The far-field zone 230 can correspond to an area of the subterranean formation 101 where the pore fluid pressure, as represented by the curve 240, approaches the pore pressure ($p_0$) of the formation 101. The pore fluid pressure can be a pressure of the fluids within pores of a reservoir. In locations distant from the wellbore zone 210, such as in the far-field zone 230, the pore fluid pressure and pore pressure can equalize because the wellbore pressure is no longer acting on the pore fluid pressure. In an example, the far-field zone 230 may begin at a point where the pore fluid pressure and the wellbore pressure approach equalization.

Figure 3:
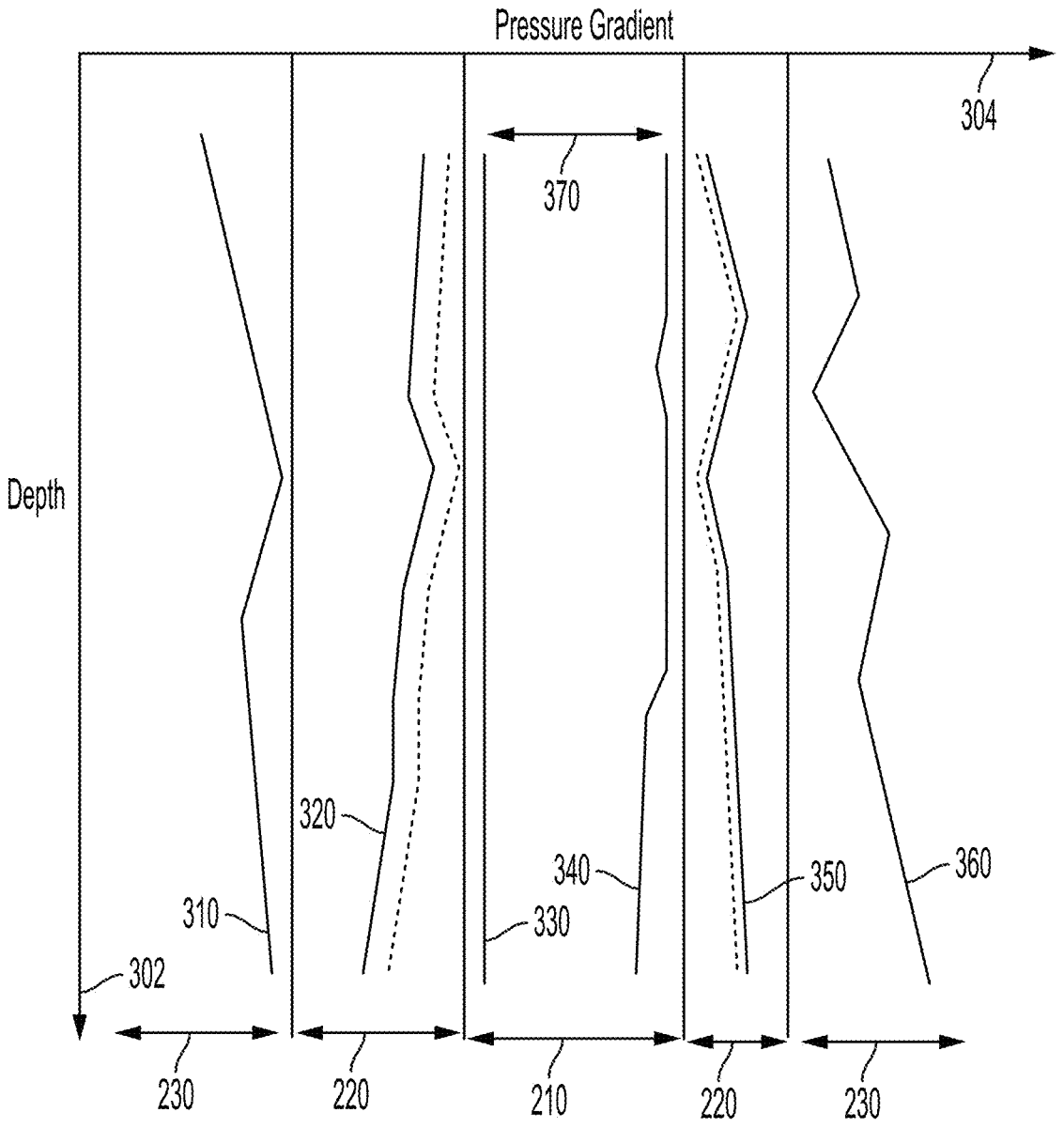
FIG. 3 is a graph of an example of an operating window of a drilling operation according to one example of the present disclosure.

FIG. 3 is a graph of an example of an operating window 370 of a drilling operation according to one example of the present disclosure. The graph depicts curves representing depth on a y-axis 302 versus pressure gradient on an x-axis 304. In an example, the curves can be generated in real time during the drilling operation of the wellbore 102. The curves can be generated by analyzing each wellbore zone of a subterranean formation and interrelating the measurements in real time. Models and simulations may be used to interrelate the measurements from each of the wellbore zones and generate the curves. The wellbore pressures, such as ESD and ECD can be modeled in real time using a hydraulics simulator (e.g., DFG RT). The hydraulics simulator can account for ROP, mud flow rate, tripping speeds, downhole rheology of the fluids, wellbore geometry (diameters, lengths, and trajectory of tool configuration, flow paths, etc.), cuttings transport, pipe rotation, downhole gel strengths, fluid density changes due to compressibility, and thermal expansion from transient thermal conditions in generating the curves. As a result, the simulations may be able to indicate weak bedding planes, changes in formation density, porosity, vugs, moduli, or other factors.

The curves can include a pore pressure curve 310, a shear collapse gradient 320, an equivalent static density 330, an equivalent circulation density 340, a fracturing pressure gradient 350, and a minimum horizontal stress gradient 360. The pore pressure curve 310 and the minimum horizontal stress gradient 360 can be associated with a far-field zone 230. The shear collapse gradient 320 and the fracturing pressure gradient 350 can be associated with a near-wellbore zone 220 and can be time dependent (as shown by the dashed lines). The equivalent static density 330 and the equivalent circulation density 340 can be associated with the wellbore zone 210.

In some examples, the operating window 370 can be an optimal range of pressure for the drilling operation. The operating window 370 can be a pressure differential between the equivalent static density 330 and the equivalent circulation density 340. As mentioned above, the shear collapse gradient 320 may increase and the fracturing pressure gradient 350 may decrease based on their time dependency during the drilling operation, causing the operating window 370 to become smaller. As a result, the equivalent static density 330 may increase and the equivalent circulation density 340 may decrease, causing a strict limit to operation. It may be desirable to analyze the operating window 370 in real time to dynamically adjust parameters of the drilling operation to stay within the operating window 370 and avoid adverse events (e.g., fluid loss, lost circulation, blowout, etc.).

Figure 4:
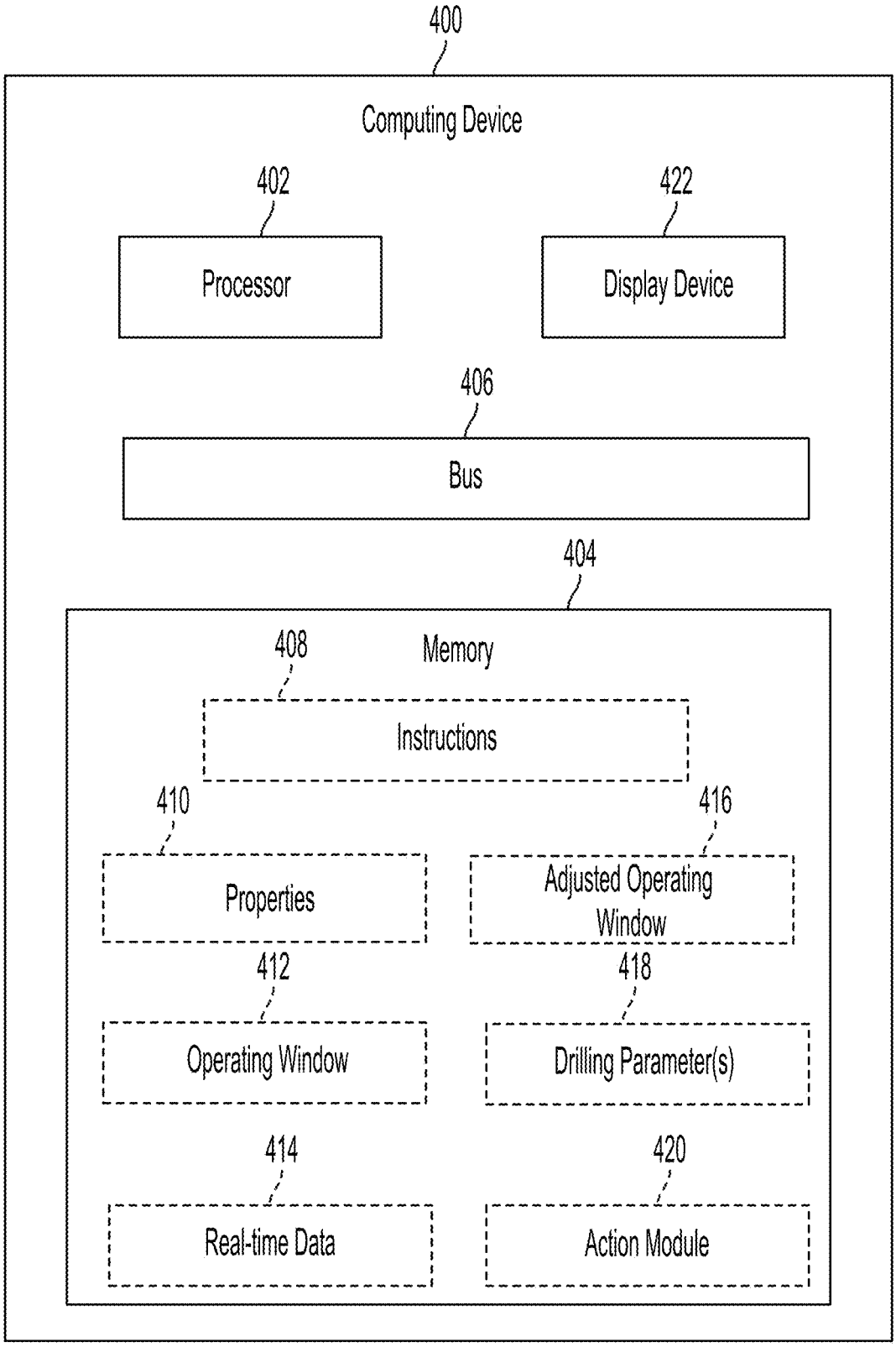
FIG. 4 is a block diagram of an example of a computing device for adjusting parameters of a drilling operation based on a calculated operating window according to one example of the present disclosure.

FIG. 4 is a block diagram of an example of a computing device 400 for adjusting parameters of a drilling operation based on a calculated operating window according to one example of the present disclosure. The computing device 400 can include a processor 402, a bus 406, a memory 404, and a display device 422. In some examples, the components shown in FIG. 4 can be integrated into a single structure. For example, the components can be within a single housing with a single processing device. In other examples, the components shown in FIG. 4 can be distributed (e.g., in separate housings) and in electrical communication with each other using various processors. It is also possible for the components to be distributed in a cloud computing system or grid computing system.

The processor 402 can execute one or more operations for determining an operating window. The processor 402 can execute instructions stored in the memory 404 to perform the operations. The processor 402 can include one processing device or multiple processing devices. Non-limiting examples of the processor 402 include a field-programmable gate array ("FPGA"), an application-specific integrated circuit ("ASIC"), a processor, a microprocessor, etc.

The processor 402 is communicatively coupled to the memory 404 via the bus 406. The memory 404 may include any type of memory device that retains stored information when powered off. Non-limiting examples of the memory 404 include electrically erasable and programmable read-only memory ("EEPROM"), flash memory, or any other type of non-volatile memory. In some examples, at least some of the memory 404 can include a non-transitory medium from which the processor 402 can read instructions. A computer-readable medium can include electronic, optical, magnetic, or other storage devices capable of providing the processor 402 with computer-readable instructions or other program code. Non-limiting examples of a computer-readable medium include (but are not limited to) magnetic disk(s), memory chip(s), read-only memory (ROM), random-access memory ("RAM"), an ASIC, a configured processing device, optical storage, or any other medium from which a computer processing device can read instructions. The instructions can include processing device-specific instructions generated by a compiler or an interpreter from code written in any suitable computer-programming language, including, for example, C, C++, C #, etc.

In some examples, the computing device 400 includes a display device 422. The display device 422 can represent one or more components used to output data. Examples of the display device 422 can include a liquid-crystal display (LCD), a computer monitor, a touch-screen display, etc.

The computing device 400 may include properties 410 of wellbore zones of the drilling operation. The wellbore zones can extend radially outward from a wellbore of the drilling operation. For example, the wellbore zones can include a wellbore zone, a near-wellbore zone, and a far-field zone. Examples of properties 410 the computing device 400 can include a wellbore geometry, fluid properties, rock-fluid interaction, and environment geology and geomechanics. The computing device 400 can determine an operating window 412 for a drilling pressure of the drilling operation based on the properties 410 of the wellbore zones. The operating window 412 can correspond to a pressure differential between a minimum equivalent static density and a maximum equivalent circulation density of the wellbore zone.

In some examples, the computing device 400 can access real-time data 414 for the wellbore zones during the drilling operation. The real-time data 414 can include measurements such as cuttings and carvings measurements as well as drilling inputs (e.g., weight-on-bit, temperature, pressure, torque, drag, rate-of-penetration, rotations per minute, wellbore trajectory, and wellbore geometry). The computing device 400 can access the real-time data 414 from a data acquisition and distribution system and sensors (e.g., BaraLogix®, applied fluids optimization and drilling fluids graphics systems). The real-time data 414 may be processed using models to generate and update a pore pressure, a shear collapse pressure, a fracturing pressure, time-dependent geomechanic properties, or a combination of these. The computing device 400 can determine an adjusted operating window 416 for the drilling operation based on the real-time data 414. For example, the operating window may shrink during the drilling operation, so the adjusted operating window 416 may be smaller than the operating window 412.

The computing device 400 may additionally output error bars and a confidence value associated with the adjusted operating window 416 during the drilling operation. The error bars can represent an indication of a range of pressures in which the adjusted operating window 416 falls between, as determined by the computing device 400. For example, a minimum value of the adjusted operating window 416 can be 50 MPa with an error bar from 49 MPa to 51 MPa, indicating the pressure range for the minimum value. The confidence value can indicate a confidence of the adjusted operating window 416 having the calculated pressure differential. The computing device 400 may determine a confidence value for the overall adjusted operating window 416 or a confidence value for each end of the adjusted operating window 416. For example, the computing device 400 can determine the adjusted operating window 416 of 50 MPa to 60 MPa has a confidence value of 80%, meaning there is an 80% likelihood that the adjusted operating window 416 is between 50 MPa and 60 MPa. The error bars and confidence values may be used to determine a likelihood of an adverse event (e.g., lost circulation, fluid loss) occurring during the drilling operation.

The computing device 400 can adjust drilling parameter (s) 418 of the drilling operation in real time based on the adjusted operating window 416. Examples of the drilling parameter(s) 418 can include a wellbore pressure, a mud weight, fluid properties, a pump rate, a rate of penetration, a drilling trajectory, or a combination of these. The computing device 400 may adjust the mud weight of the drilling fluid based on concerns associated with the equivalent static density. Additionally, the computing device 400 may adjust the pump rate and mud composition based concerns associated with the equivalent circulation density. The computing device 400 can determine adjustments for the drilling parameter(s) 418 at a measured depth and ahead of bit using data analytics, artificial intelligence, or physics-based modeling. The computing device 400 can additionally make remedial adjustments based on determining the adjusted operating window 416 indicates the operating window 412 is converging too quickly. For example, the computing device 400 may case a section of the wellbore if the operating window is converging too quickly. The computing device 400 can include an action module 420 that can implement the adjustments for the drilling parameter(s) 418.

The computing device 400 may additionally or alternatively adjust the drilling parameter(s) 418 in response to detecting an event based on the real-time data 414. To do this, the computing device 400 can determine event indicators occurring in each of the wellbore zones from the real-time data 414. The event indicators can be known changes or patterns in the real-time data 414. An event indicator may additionally be an indication that the adjusted operating window 416 is converging too quickly from the operating window 412. The computing device 400 can order and compare the event indicators to generate the event detection.

In some examples, the computing device 400 can perform a simulation for the drilling operation based on the real-time data 414. The simulation can use the properties 410 and real-time data 414 to determine the adjusted operating window 416 and adjustments for the drilling parameter(s) 418 to mitigate problems of the drilling operation in real time. For example, the computing device 400 can perform a hydraulic simulation when the real-time data 414 indicates a pressure-while-drilling is within the adjusted operating window 416. The hydraulic simulation can determine adjustments for drilling parameter(s) to adjust the pressure-while-drilling without causing an adverse event.

Figure 5:
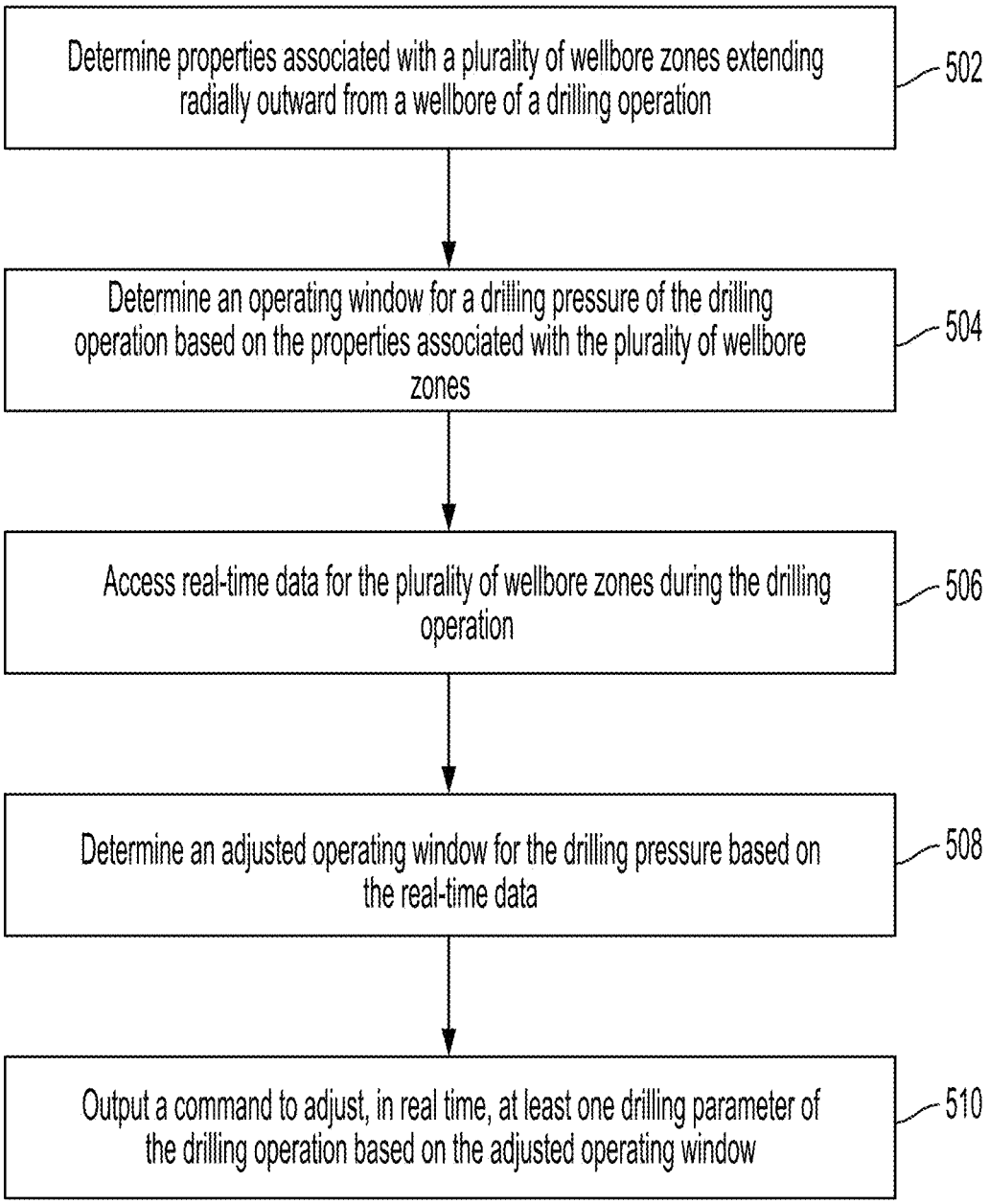
FIG. 5 is a flowchart of an example of a process for adjusting parameters of a drilling operation based on a calculated operating window according to one example of the present disclosure.

In some examples, the computing device 400 can implement the process shown in FIG. 5 for effectuating some aspects of the present disclosure. Other examples can involve more operations, fewer operations, different operations, or a different order of the operations shown in FIG. 5. The operations of FIG. 5 are described below with reference to the components shown in FIG. 5.

At block 502, the processor 402 can determine properties 410 associated with a plurality of wellbore zones extending radially outward from a wellbore of a drilling operation. The plurality of wellbore zones can include a wellbore zone 210, a near-wellbore zone 220, and a far-field zone 230. The properties 410 can include a wellbore geometry, fluid properties, rock-fluid interaction, and environment geology and geomechanics.

At block 504, the processor 402 can determine an operating window 412 for a drilling pressure of the drilling operation based on the properties 410 associated with the plurality of wellbore zones. The operating window 412 can be a pressure differential between a minimum equivalent static density of the wellbore zone and a maximum equivalent circulation density of the wellbore zone.

At block 506, the processor 402 can access real-time data 414 for the plurality of wellbore zones during the drilling operation. The real-time data 414 can be accessed from downhole sensors or other drilling equipment. The real-time data can include cuttings and carvings measurements as well as drilling inputs (e.g., weight-on-bit, torque, drag, rate-of-penetration, rotations per minute, wellbore trajectory, and wellbore geometry). The computing device 400 can access the real-time data 414 from a data acquisition and distribution system and sensors (e.g., BaraLogix®, applied fluids optimization and drilling fluids graphics systems). The real-time data 414 may be processed using models to generate and update a pore pressure, shear collapse pressure, and fracturing pressure.

At block 508, the processor 402 can determine an adjusted operating window 416 for the drilling pressure based on the real-time data 414. The adjusted operating window 416 may be smaller than the operating window 412 based on the shear collapse pressure increasing during the drilling operation and the fracturing pressure decreasing during the drilling operation.

At block 510, the processor 402 can output a command to adjust, in real-time, at least one drilling parameter 418 of the drilling operation based on the adjusted operating window 416. The at least one drilling parameter 418 can be adjusted based on the adjusted operating window 416 indicating an adverse event is detected, or based on the adjusted operating window 416 indicating the operating window 412 is converging too quickly. Additionally, the processor 402 can perform a simulation and adjust the at least one drilling parameter 418 based on the simulation. The at least one drilling parameter can include a wellbore pressure, a mud weight, fluid properties, a pump rate, a rate of penetration, a drilling trajectory, or any combination of these. Adjusting the at least one drilling parameter 418 can maintain wellbore stability and reduce nonproductive time for the wellbore operation.

In some aspects, a system, a method, and a non-transitory computer-readable medium for adjusting parameters of a drilling operation are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a processing device; and a memory device that includes instructions executable by the processing device for causing the processing device to: determine properties associated with a plurality of wellbore zones extending radially outward from a wellbore of a drilling operation; determine an operating window for a drilling pressure of the drilling operation based on the properties associated with the plurality of wellbore zones; access real-time data for the plurality of wellbore zones during the drilling operation; determine an adjusted operating window for the drilling pressure based on the real-time data; and output a command to adjust, in real time, at least one drilling parameter of the drilling operation based on the adjusted operating window.

Example 2 is the system of example 1, wherein the memory device further includes instructions executable by the processing device for causing the processing device to: detect an adverse event based on the real-time data; and adjust the at least one drilling parameter of the drilling operation based on the detection of the adverse event.

Example 3 is the system of examples 1-2, wherein the at least one drilling parameter comprises a wellbore pressure, a mud weight, fluid properties, a pump rate, a rate of penetration, a drilling trajectory, or any combination thereof.

Example 4 is the system of examples 1-3, wherein the plurality of wellbore zones comprises a wellbore zone, a near-wellbore zone, and a far-field zone.

Example 5 is the system of example 4, wherein the operating window comprises a pressure differential between a minimum equivalent static density of the wellbore zone and a maximum equivalent circulation density of the wellbore zone.

Example 6 is the system of examples 1-5, wherein the memory device further includes instructions executable by the processing device for causing the processing device to: perform a simulation for the drilling operating based on the real-time data; and adjust the at least one drilling parameter of the drilling operation based on the simulation.

Example 7 is the system of examples 1-6, wherein the real-time data comprise a weight-on-bit, temperature, pressure, torque, drag, rate-of-penetration, rotations per minute, wellbore trajectory, wellbore geometry, or a combination thereof and are usable to generate a pore pressure, a shear collapse pressure, a fracturing pressure, time-dependent geomechanic properties, or a combination thereof.

Example 8 is the system of examples 1-7, wherein the memory device further includes instructions executable by the processing device for causing the processing device to output error bars and a confidence value associated with the adjusted operating window during the drilling operation.

Example 9 is a method comprising: determining properties associated with a plurality of wellbore zones extending radially outward from a wellbore of a drilling operation; determining an operating window for a drilling pressure of the drilling operation based on the properties associated with the plurality of wellbore zones; accessing real-time data for the plurality of wellbore zones during the drilling operation; determining an adjusted operating window for the drilling pressure based on the real-time data; and outputting a command to adjust, in real time, at least one drilling parameter of the drilling operation based on the adjusted operating window.

Example 10 is the method of example 9, further comprising: detecting an adverse event based on the real-time data; and adjusting the at least one drilling parameter of the drilling operation based on the detection of the adverse event.

Example 11 is the method of examples 9-10, wherein the at least one drilling parameter comprises a wellbore pressure, a mud weight, fluid properties, a pump rate, a rate of penetration, a drilling trajectory, or any combination thereof.

Example 12 is the method of examples 9-11, wherein the plurality of wellbore zones comprises a wellbore zone, a near-wellbore zone, and a far-field zone.

Example 13 is the method of example 12, wherein the operating window comprises a pressure differential between a minimum equivalent static density of the wellbore zone and a maximum equivalent circulation density of the wellbore zone.

Example 14 is the method of examples 9-13, further comprising: performing a simulation for the drilling operation based on the real-time data; and adjusting the at least one drilling parameter of the drilling operation based on the simulation.

Example 15 is the method of examples 9-14, wherein the real-time data comprise a pore pressure, a shear collapse pressure, a fracturing pressure, time-dependent geomechanic properties, or a combination thereof.

Example 16 is a non-transitory computer-readable medium comprising instructions that are executable by a processing device for causing the processing device to perform operations comprising: determining properties associated with a plurality of wellbore zones extending radially outward from a wellbore of a drilling operation; determining an operating window for a drilling pressure of the drilling operation based on the properties associated with the plurality of wellbore zones; accessing real-time data for the plurality of wellbore zones during the drilling operation; determining an adjusted operating window for the drilling pressure based on the real-time data; and outputting a command to adjust, in real time, at least one drilling parameter of the drilling operation based on the adjusted operating window.

Example 17 is the non-transitory computer-readable medium of example 16, further comprising instructions that are executable by the processing device for causing the processing device to: detect an event based on the real-time data; and adjust the at least one drilling parameter of the drilling operation based on the detection.

Example 18 is the non-transitory computer-readable medium of examples 16-17, wherein the at least one drilling parameter comprises a wellbore pressure, a mud weight, fluid properties, a pump rate, a rate of penetration, a drilling trajectory, or any combination thereof.

Example 19 is the non-transitory computer-readable medium of examples 16-18, wherein the plurality of wellbore zones comprises a wellbore zone, a near-wellbore zone, and a far-field zone.

Example 20 is the non-transitory computer-readable medium of example 19, wherein the operating window comprises a pressure differential between a minimum equivalent static density of the wellbore zone and a maximum equivalent circulation density of the wellbore zone.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a processing device; and a memory device that includes instructions executable by the processing device for causing the processing device to:

determine properties associated with a plurality of wellbore zones at a particular depth in a wellbore that is associated with a drilling operation, the plurality of wellbore zones extending radially outward from the wellbore at the particular depth;

determine an operating window for a drilling pressure of the drilling operation based on the properties associated with the plurality of wellbore zones, wherein the operating window is a range of pressures between a lower pressure value and an upper pressure value;

access real-time data for the plurality of wellbore zones during the drilling operation;

determine an adjusted operating window for the drilling pressure based on the real-time data; and output a command to adjust, in real time, at least one drilling parameter of the drilling operation based on the adjusted operating window.

2. The system of claim 1, wherein the memory device further includes instructions executable by the processing device for causing the processing device to:

detect an adverse event based on the real-time data; and adjust the at least one drilling parameter of the drilling operation based on the detection of the adverse event.

3. The system of claim 1, wherein the at least one drilling parameter comprises a wellbore pressure, a mud weight, fluid properties, a pump rate, a rate of penetration, a drilling trajectory, or any combination thereof.

4. The system of claim 1, wherein the plurality of wellbore zones comprises a wellbore zone, a near-wellbore zone, and a far-field zone.

5. The system of claim 4, wherein the operating window comprises a pressure differential between a minimum equivalent static density of the wellbore zone and a maximum equivalent circulation density of the wellbore zone.

6. The system of claim 1, wherein the memory device further includes instructions executable by the processing device for causing the processing device to:

perform a simulation for the drilling operation based on the real-time data; and adjust the at least one drilling parameter of the drilling operation based on the simulation.

7. The system of claim 1, wherein the real-time data comprise a weight-on-bit, temperature, pressure, torque, drag, rate-of-penetration, rotations per minute, wellbore trajectory, wellbore geometry, or a combination thereof and are usable to generate a pore pressure, a shear collapse pressure, a fracturing pressure, time-dependent geomechanic properties, or a combination thereof.

8. The system of claim 1, wherein the memory device further includes instructions executable by the processing device for causing the processing device to output error bars and a confidence value associated with the adjusted operating window during the drilling operation.

9. A method comprising:

determining, by a processing device, properties associated with a plurality of wellbore zones at a particular depth in a wellbore that is associated with a drilling operation, the plurality of wellbore zones extending radially outward from the wellbore at the particular depth;

determining, by the processing device, an operating window for a drilling pressure of the drilling operation based on the properties associated with the plurality of wellbore zones, wherein the operating window is a range of pressures between a lower pressure value and an upper pressure value;

accessing, by the processing device, real-time data for the plurality of wellbore zones during the drilling operation;

determining, by the processing device, an adjusted operating window for the drilling pressure based on the real-time data; and outputting, by the processing device, a command to adjust, in real time, at least one drilling parameter of the drilling operation based on the adjusted operating window.

10. The method of claim 9, further comprising:

detecting an adverse event based on the real-time data; and adjusting the at least one drilling parameter of the drilling operation based on the detection of the adverse event.

11. The method of claim 9, wherein the at least one drilling parameter comprises a wellbore pressure, a mud weight, fluid properties, a pump rate, a rate of penetration, a drilling trajectory, or any combination thereof.

12. The method of claim 9, wherein the plurality of wellbore zones comprises a wellbore zone, a near-wellbore zone, and a far-field zone.

13. The method of claim 12, wherein the operating window comprises a pressure differential between a minimum equivalent static density of the wellbore zone and a maximum equivalent circulation density of the wellbore zone.

14. The method of claim 9, further comprising:

performing a simulation for the drilling operation based on the real-time data; and adjusting the at least one drilling parameter of the drilling operation based on the simulation.

15. The method of claim 9, wherein the real-time data comprise a pore pressure, a shear collapse pressure, a fracturing pressure, time-dependent geomechanic properties, or a combination thereof.

16. A non-transitory computer-readable medium comprising instructions that are executable by a processing device for causing the processing device to perform operations comprising:

determining properties associated with a plurality of wellbore zones extending radially outward from a wellbore of a drilling operation;

determining an operating window for a drilling pressure of the drilling operation based on the properties associated with the plurality of wellbore zones, wherein the operating window comprises a pressure differential between a minimum equivalent static density of a wellbore zone and a maximum equivalent circulation density of the wellbore zone, the wellbore zone being one of the plurality of wellbore zones;

accessing real-time data for the plurality of wellbore zones during the drilling operation;

determining an adjusted operating window for the drilling pressure based on the real-time data; and outputting a command to adjust, in real time, at least one drilling parameter of the drilling operation based on the adjusted operating window.

17. The non-transitory computer-readable medium of claim 16, further comprising instructions that are executable by the processing device for causing the processing device to:

detect an event based on the real-time data; and adjust the at least one drilling parameter of the drilling operation based on the detection.

18. The non-transitory computer-readable medium of claim 16, wherein the at least one drilling parameter comprises a wellbore pressure, a mud weight, fluid properties, a pump rate, a rate of penetration, a drilling trajectory, or any combination thereof.

19. The non-transitory computer-readable medium of claim 16, wherein the plurality of wellbore zones comprises a wellbore zone, a near-wellbore zone, and a far-field zone.

20. The non-transitory computer-readable medium of claim 16, wherein the plurality of wellbore zones are at a particular depth in the wellbore such that the plurality of wellbore zones extend radially outward from the wellbore at the particular depth.

* * * * *